US009273913B2

(12) United States Patent
Steinbauer et al.

(10) Patent No.: US 9,273,913 B2
(45) Date of Patent: Mar. 1, 2016

(54) HEAT EXCHANGER WITH CENTRAL PIPE AND RING CHANNEL

(75) Inventors: Manfred Steinbauer, Raisting (DE); Christiane Kerber, Pocking (DE); Jurgen Spreemann, Rosenheim (DE); Luis Matamoros, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 784 days.

(21) Appl. No.: 13/445,981

(22) Filed: Apr. 13, 2012

(65) Prior Publication Data

US 2012/0261103 A1 Oct. 18, 2012

(30) Foreign Application Priority Data

Apr. 14, 2011 (DE) ..... 10 2011 017 030

(51) Int. Cl.
*F28D 5/02* (2006.01)
*F28F 9/02* (2006.01)
*F28D 7/02* (2006.01)

(52) U.S. Cl.
CPC ..... *F28F 9/026* (2013.01); *F28D 7/024* (2013.01)

(58) Field of Classification Search
CPC ..... F28D 5/02; F28D 7/024
USPC ..... 165/163, 159, 161, 160, 115
See application file for complete search history.

(56) References Cited

U.S. PATENT DOCUMENTS

| | | | | | |
|---|---|---|---|---|---|
| 2,639,947 | A * | 5/1953 | Schaub et al. | ..... | 239/500 |
| 3,385,352 | A * | 5/1968 | Engalitcheff, Jr. | ..... | F28D 5/02 159/13.4 |
| 4,094,734 | A * | 6/1978 | Henderson | ..... | 159/13.2 |
| 4,893,672 | A * | 1/1990 | Bader | ..... | 165/163 |
| 5,291,944 | A * | 3/1994 | Sanz et al. | ..... | 165/159 |
| 6,868,695 | B1 * | 3/2005 | Dingel et al. | ..... | 62/515 |
| 7,205,533 | B2 * | 4/2007 | Hingst | ..... | 250/239 |
| 7,670,572 | B2 * | 3/2010 | Porscha | ..... | 422/605 |
| 8,087,454 | B2 | 1/2012 | Kerber et al. | | |
| 8,561,675 | B2 * | 10/2013 | Liu et al. | ..... | 165/115 |
| 2008/0115918 | A1 | 5/2008 | Kerber et al. | | |
| 2008/0296004 | A1 * | 12/2008 | Steinbauer et al. | ..... | 165/163 |

FOREIGN PATENT DOCUMENTS

| | | | | |
|---|---|---|---|---|
| DE | 10 2004 040 974 A1 | | 3/2006 | |
| WO | WO 2006/021315 | * | 3/2006 | ..... F28D 5/02 |

* cited by examiner

*Primary Examiner* — Leonard R Leo
*Assistant Examiner* — Gustavo Hincapie Serna
(74) *Attorney, Agent, or Firm* — Millen, White, Zelano, Branigan, P.C.

(57) ABSTRACT

The invention relates to a heat exchanger (1) having a tube bundle (10) with a large number of tubes wound around a central pipe (100), a shell (20) enclosing the tube bundle (10) and defining a shell space (200) surrounding the tube bundle (10), and a liquid distributor (30) having distributor arms (300) for distributing a liquid (F) into the shell space (200) and onto the tube bundle (10), and drain pipes (340) for supplying the distributor arms with liquid (F). The distributor arms (300) are connected in a flow-guiding manner to a ring channel (400) positioned along the periphery of the shell (20). For degassing liquid (F), central pipe (100) is connected in a flow-guiding manner to the distributor arms (300).

19 Claims, 2 Drawing Sheets

HEAT EXCHANGER WITH CENTRAL PIPE AND RING CHANNEL

SUMMARY OF THE INVENTION

The invention relates to heat exchanger systems comprising a tube bundle, with a large number of tubes wound around a central pipe, a shell enclosing the tube bundle and defines a shell space surrounding the tube bundle, and a liquid distributor having distributor arms for distributing a liquid into the shell space on the tube bundle.

Such a heat exchanger is set up and provided for indirect heat exchange between at least a first medium that is guided in a tube bundle and a two-phase mixture (gas/liquid) that is guided in the shell space. The tube bundle has a large number of tubes that are wound around a central pipe and the shell space is defined by a shell that encloses the tube bundle. In addition, there is provided a liquid distributor with distributor arms for distributing the liquid into the shell space on the tube bundle. In order to supply the distributor arms with liquid via drain tubes, the distributor arms are connected in a flow-guiding manner to a ring channel that is positioned along the periphery of the shell.

Such a heat exchanger is known from DE 10 2004 040 974 A1.

On the shell side, liquid distributor systems for degassing and calming the liquid that is to be distributed can additionally be designed in such a way that the two-phase liquid/gas mixture is calmed and degassed, e.g., in a pre-distributor system, which in most cases has a ring channel and, in a second stage, a collection pan. The degassed liquid is accumulated via a vertical pipe to generate pressure and then is fed to the actual main distributor system. The liquid is directed from this vertical pipe into the distributor arms, from where it rains down through holes onto the tube bundle lying below. By the liquid falling into the vertical pipe, however, gas bubbles can be introduced into the liquid. The rate of descent in the vertical pipe is so high that trapped gas bubbles cannot ascend against the flow of liquid. They are thus further entrained into the distributor arms and can then negatively influence the liquid distribution onto the tube bundle.

An aspect of the invention therefore is to further improve a heat exchanger of the above-mentioned type with respect to the distribution of liquid within the shell space.

Upon further study of the specification and appended claims, other aspects and advantages of the invention will become apparent.

The problem of achieving better liquid distribution is solved by a heat exchanger system in which the central pipe provides for degassing of the liquid (F) to be distributed that accumulates in distributor arms of the liquid distributor, and the central pipe is connected in a flow-guiding manner to the distributor arms (300).

Thus, the central pipe of the heat exchanger provides for degassing of the liquid to be distributed that accumulates in the distributor arms, the central pipe also being connected in a flow-guiding manner to the distributor arms. That is to say in particular that the central pipe, through which to date the liquid was directed downward, now functions as or is designed as a degassing chimney.

Thus, on the one hand, the two-stage nature of previous systems (see above) is dealt with, since in the heat exchanger according to the invention, the liquid flows from the ring channel via the drain pipes directly into the assigned distributor arms. In addition, the heat exchanger includes an effective way of degassing liquid contained within the ring channel, namely through the central pipe as a degassing means, which is filled with standing liquid. In accordance with the invention, by the guiding of the liquid flow into the ring channel, in particular a considerably higher dwell time and thus a reduced rate of descent of the liquid can be implemented.

In addition, the central pipe according to the invention preferably has provides the function of preventing a possible improper distribution between the distributor arms. This is achieved by allowing a transfer of liquid from one distributor arm to another, i.e., the distributor arms are connected to one another in a flow-guiding manner for equal distribution of the liquid to the tube bundle preferably via the central pipe, and namely in particular via slot-shaped through openings in the central pipe.

The central pipe extends in a state that is arranged as directed—preferably along the vertical—whereby the central pipe preferably runs along a longitudinal axis (axis of the cylinder) of the preferably essentially hollow-cylindrical shell, namely in particular coaxially to the shell. The slot-shaped through openings preferably also extend along the vertical on the central pipe.

Since the liquid that is to be distributed and that is accommodated in the distributor arms can be degassed via the central pipe, preferably one or more degassing chimneys are arranged in the central pipe (or the degassing chimney is formed only by the central pipe), whereby each degassing or distributor chimney is connected in a flow-guiding manner to the individual distributor arms, namely in particular via the slot-shaped through openings.

To support degasification of the liquid in the distributor arms, the latter preferably have roofs—relative to a state of the heat exchanger that is arranged as directed—for limiting the distributor arms in the upward direction. Each roof is sloped towards the respective base (perforated base) of the corresponding distributor arm, via which the liquid that is to be distributed rains on the tube bundle arranged thereunder, and rise upwards toward the central pipe, from which the individual distributor arms (in the radial direction of the shell) extend. Thus, gas bubbles that are drawn into the distributor arms can easily migrate to the inwardly, upwardly sloping roofs of the distributor arms inward toward the central pipe/degassing chimney and then optionally escape via the central pipe or the degassing chimney that is accommodated therein.

Preferably, the liquid distributor for introducing liquid into the ring channel has a baffle box that is extended along the central pipe for accommodating the liquid that is to be distributed. The baffle box empties downward (relative to a state of the heat exchanger that is arranged as directed) and laterally into the ring channel. In this way, the baffle box preferably has a baffle wall that is extended along the central pipe, which baffle wall is opposite an intake of the liquid distributor for introducing liquid into the baffle box in the radial direction of the shell. Liquid that is introduced via the intake into the baffle box flows against the baffle wall and then drops downward. The inflowing liquid strikes the liquid surface there. Gas and liquid now have enough time to separate in the ring channel, and optionally gas bubbles that are entrained downward can rise against the movement of the liquid.

In addition, the baffle box is designed to be preferably closed in the upward direction. To this end, the baffle box can have a roof, which extends from the baffle wall to the shell, which can limit the baffle box on a side that faces away from the central pipe.

At the lower end, the baffle wall preferably has a free end region positioned within the ring channel, whereby liquid can run off on the baffle wall into the ring channel. Each free end region of the baffle wall is arranged in particular at a distance from a circumferential inside wall of the ring channel that faces the central pipe. The baffle boxes can also be self-contained in the downward direction (i.e., they can have a bottom or base plate), then gas and liquid only flow off to the side. The liquid then drops onto both sides of the base in the ring channel.

Since gas bubbles that are drawn into the baffle boxes can easily be removed, the baffle boxes preferably have open sides on both sides of the baffle walls via which gas bubbles can escape.

As a result, the liquid distributor according to the invention thus forms a one-stage system. In particular, the liquid distributor is designed in such a way that when the heat exchanger is operating properly, the liquid has a defined retaining height in the ring channel. This is generally applies even for the guaranteed partial load case.

In light of the improved liquid distribution in accordance with the invention, the heating surface of the heat exchanger can be optimally used. The design can also be used in floating-LNG units (off-shore liquefied natural gas units), since the annular space of the ring channel can be divided in a simple way into segments to prevent the system from spilling over or building up; i.e., the ring channel is preferably divided into segments in such a way that a liquid that stands in the ring channel is calmed when the spatial coordinates of the ring channel change by dividing the ring channel into segments. These segments are preferably formed in each case by two walls that are opposite one another and that project from the base of the ring channel, whereby starting at a certain liquid level of a segment, the liquid preferably can reach the surrounding segments (by flowing over the respective wall).

In addition, this heat exchanger can be provided with an adjustable liquid distributor. In this respect, the ring channel can be divided into segments that then supply different distributor arms. In the different embodiments or distributions of the through holes made at the base of the distributor arms, through which the liquid rains onto the tube bundle lying below, the liquid transfer to specific sections of the bundle can then be influenced specifically. In this way, the supply of the individual segments for each segment is preferably designed to be separately adjustable (e.g., by means of corresponding valves that are assigned to the individual segments).

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

Additional features and advantages of the invention are to be explained below in the description of the figures of an embodiment based on the figures.

Figure 1:
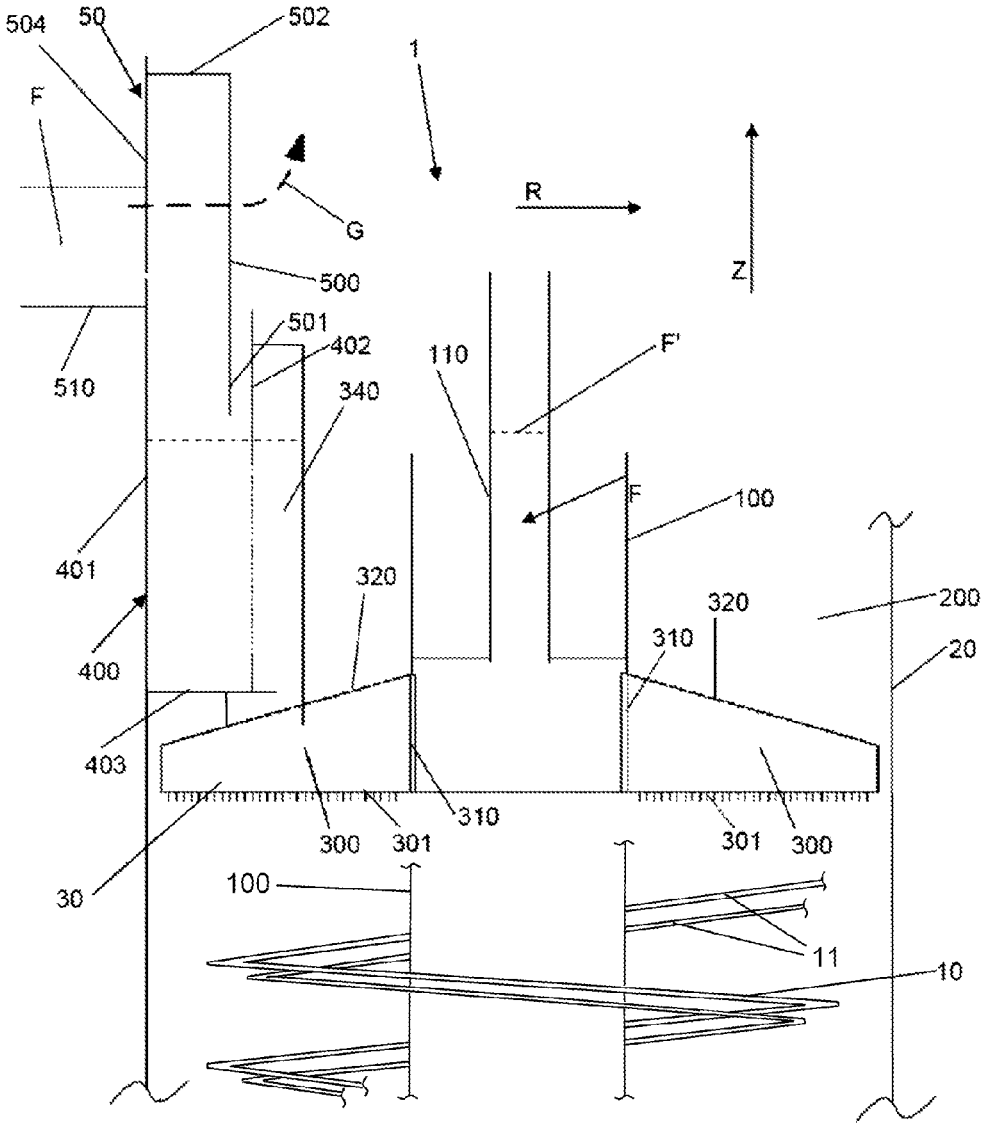
Figure 2:
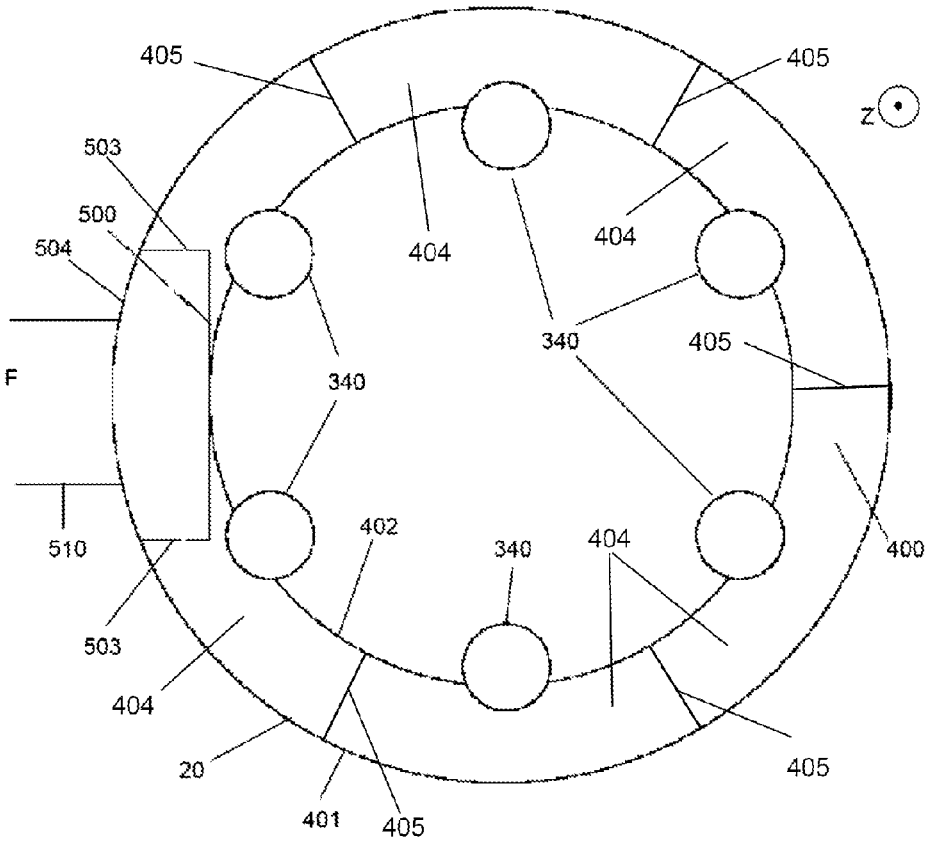

Here:

FIG. 1 shows a diagrammatic, fragmentary sectional view of a heat exchanger with a liquid distributor; and FIG. 2 shows a diagrammatic, partially cut top view of a ring channel of the liquid distributor according to FIG. 1.

In connection with FIG. 2, FIG. 1 shows a heat exchanger 1 according to the invention. The heat exchanger 1 has a pressurized, in particular hollow-cylindrical shell 20, which extends along a longitudinal axis (axis of the cylinder) that—relative to a state of the heat exchanger 1 that is arranged as directed—runs parallel to the vertical Z. The shell 20 limits a shell space 200, in which at least one tube bundle 10 that defines a tube space is arranged. The tube bundle is formed from a large number of tubes 11 that are wound (in several layers) around a central pipe 100, whose longitudinal axis coincides with the longitudinal axis of the shell 20. The tube space is used to accommodate a first medium, which enters into indirect heat exchange with a liquid F that is guided into the shell space 200.

Above the tube bundle 10, a liquid distributor 30 is arranged, which is designed in a way to distribute the liquid F to a cross-section of the shell space 200 that runs perpendicular to the vertical Z or to feed the liquid to the tube bundle 10.

To be able to supply the liquid distributor 30 with liquid F, an inlet 510 is provided on the shell 20 (e.g., in the form of a pipe connection that is provided on the shell 20). Inlet 510 empties into a baffle box 50, which extends into the shell space 200 along the vertical Z. The baffle box 50 is limited outward by an outside wall 504 that is formed by the shell 20. A baffle wall 500 of the baffle box 50 is provided opposite the outside wall 504. Baffle wall 500 is arranged relative to the intake 510 in such a way that the liquid F that flows from the intake 510 into the baffle box 50 strikes the baffle wall 500 and flows downward within the baffle box 50, whereby the latter empties downward into a ring channel 400. The liquid F collects in ring channel 400 in such a way that when the heat exchanger 1 is operating properly, the liquid F stands in the ring channel 400 (liquid level F' above distributor arms 300, see below). In this respect, the liquid F can advantageously be calmed and degassed. In the upward direction, baffle box 50 is limited by a roof 502, but preferably has open sides 503 (see FIG. 2) on both sides of the baffle wall 500, via which gas bubbles G that are entrained by the liquid F can escape upward from the liquid distributor 30. In addition, the baffle wall 500 can have a free end region 501 (or can have a base plate below), which stands in the ring channel 400. Also, there is a gap provided between the baffle wall 500 and the inside wall 402 of the ring channel (see below) along the radial direction R. Thus, the liquid F can always flow off on the baffle wall 500 up to the ring channel 400.

The ring channel 400 itself is positioned along the periphery of the shell 20 in a plane that is oriented perpendicular to the longitudinal axis of the shell 20, whereby a circumferential outside wall 401 of the ring channel 400 is formed by the shell 20, which is opposite the circumferential inside wall 402 of the ring channel 400. Outside and inside walls 401, 402 of the ring channel 400 are connected to one another via base 403 of the ring channel 400, which limits the ring channel 400 downward. As shown in FIG. 2, the ring channel is divided into segments 404. Each of these segments is formed by two walls 405 that are opposite one another and that project from the base of the ring channel.

The ring channel 400, for its part, is connected via a large number of drain pipes 340 extended along the vertical Z to a large number of distributor arms 300, which extend outward to the shell 20 starting from the central pipe 100 in the radial direction R of the shell 20. The distributor arms 300 can be designed, in particular, in the shape of pie slices (shaped like an arc sector). The distributor arms 300 thus can be supplied from the ring channel 400 with the liquid F via drain pipes 340. Between the distributor arms 300, in particular gaps (through or passage areas) can be formed, by which tubes of the tube bundle 10 can be guided through along the vertical Z.

The distributor arms 300 are limited downward in each case by a base 301. Each base (perforated base) 301 has a large number of through holes, through which liquid F located in the distributor arms 300 can rain onto the tube bundle 10, and as a result liquid F can travel in indirect heat exchange with the medium that is guided through the tube space. In addition, the distributor arms 300 are connected in each case via a preferably slot-shaped through opening 310 to a degassing chimney 110, arranged coaxially in the central pipe 100. As shown in FIG. 1, the degassing chimney 110 is connected to the central pipe 100 by a platform (e.g., an annular shaped stage) extending inwards from the periphery of central pipe 100. Degassing chimney 110 has an outside diameter in certain sections that is smaller than the corresponding inside diameter of the central pipe 100. Gas bubbles that are drawn into the distributor arms 300 can escape upward (via the central pipe 100) via this degassing chimney 110. To support the degasification, the distributor arms 300 in each case have roofs 320 ascending towards the central pipe 100, i.e., appropriately sloped upwards from the respective base 301, along which roofs the gas bubbles can rise into the degassing chimney 110. The central pipe 100 thus does not act, according to the invention, as an inlet for the distributor arms 300, but rather as a degassing or distributor chimney.

The entire disclosure[s] of all applications, patents and publications, cited herein and of corresponding German Application No. 10 2011 017 030.8, filed Apr. 14, 2011, are incorporated by reference herein.

The preceding examples can be repeated with similar success by substituting the generically or specifically described reactants and/or operating conditions of this invention for those used in the preceding examples.

| List of Reference Symbols | |
|---|---|
| 1 | Heat Exchanger |
| 10 | Tube Bundle |
| 11 | Wound tubes |
| 20 | Shell |
| 30 | Liquid Distributor |
| 50 | Baffle Box |
| 100 | Central Pipe |
| 110 | Degassing Chimney |
| 200 | Shell Space |
| 300 | Distributor Arm |
| 301 | Base |
| 310 | Through Opening |
| 320 | Roof |
| 340 | Drain Pipe |
| 400 | Ring Channel |
| 401 | Outside Wall |
| 402 | Inside Wall |
| 403 | Base |
| 404 | Ring Channel Segment |
| 405 | Wall Seperating Ring Channel Segments |
| 500 | Baffle Wall |
| 501 | Free End Area |
| 502 | Roof |
| 504 | Outside Wall |
| 510 | Intake |
| F | Liquid |
| F' | Liquid Level |
| R | Radial Direction |
| Z | Vertical |

The invention claimed is:

1. A heat exchanger comprising:

a tube bundle (10) comprising a plurality of tubes wound around a central pipe (100), a shell (20) enclosing said tube bundle (10) and defining a shell space (200) that surrounds said tube bundle (10), and a liquid distributor (30) comprising distributor arms (300) for distributing a liquid (F) into said shell space (200) and onto said tube bundle (10), and drain pipes (340) for supplying said distributor arms (300) with liquid (F), wherein said distributor arms (300) are connected in a flow-guiding manner to a ring channel (400) that is positioned along the periphery of the shell (20), whereby liquid can flow from said ring channel (400) via said drain pipes (340) directly into said distributor arms (300), and wherein said central pipe (100) provides for degassing liquid (F) to be distributed that is accumulated in said distributor arms (300), and said central pipe (100) is connected in a flow-guiding manner to said distributor arms (300).

2. The heat exchanger according to claim 1, wherein said distributor arms (300) are connected to one another in a flow-guiding manner via said central pipe (100) to provide uniform distribution of liquid (F) to said tube bundle (10).

3. The heat exchanger according to claim 1, wherein said distributor arms (300) are connected to said central pipe (100) by slotted through openings (310).

4. The heat exchanger according to claim 1, further comprising a degassing chimney (110) is arranged within said central pipe (100), wherein said chimney is connected to the distributor arms (300) in a flow-guiding manner via slotted through openings (310) to provide for degassing liquid (F) contained in said distributor arms (300).

5. The heat exchanger according to claim 1, wherein said distributor arms (300)—relative to a state of the heat exchanger (1) that is arranged as directed—are limited in the upward direction by a roof (320) that ascends towards said central pipe (100).

6. The heat exchanger according to claim 1, wherein each of said distributor arms (300) run in the radial direction (R) of said shell (20) crosswise to said central pipe (100).

7. The heat exchanger according to claim 1, wherein said liquid distributor (30) has a baffle box (50) for introducing liquid into said ring channel (400), wherein said baffle box (50) empties downward into said ring channel (400).

8. The heat exchanger according to claim 7, wherein said baffle box (50) has a baffle wall (500) that is extended in the direction of said central pipe (100), said baffle wall (500) being opposite to an inlet (510) to said liquid distributor (30) for introducing liquid (F) into said baffle box (50) in such a way that liquid (F) introduced via said inlet (510) into said baffle box (50) strikes said baffle wall (500) and flows downward into said baffle box (50), wherein said baffle box (50) is closed in the upward direction, and said baffle wall (500) extends downward and has a free end region (501) in said ring channel (400) or said baffle box has a base plate at the bottom thereof, and each free end region (501) is arranged at a distance from a circumferential inside wall (402) of said ring channel (400) that faces said central pipe (100).

9. The heat exchanger according to claim 8, wherein, for removing gas (G) entrained by liquid (F), said baffle box (50) has open sides (503) that are opposite one another on both sides of said baffle wall (500).

10. The heat exchanger according to claim 1, wherein said liquid distributor (30) is designed in such a way that when said heat exchanger (1) is operating, liquid (F) has a defined retaining height in said ring channel (400).

11. The heat exchanger according to claim 1, wherein said ring channel (400) is divided into segments in such a way that liquid (F) standing in said ring channel (400) is calmed when the spatial coordinates of said ring channel (400) change by dividing said ring channel into segments, wherein each of said segments of said ring channel (400) are formed by two walls that project from a base (403) of said ring channel (400).

12. The heat exchanger according to claim 11, wherein a first segment of said ring channel (400) supplies a first distributor arm, and a second segment of said ring channel (400) supplies a second distributor arm, different from said first distributor arm, with liquid (F) to be distributed.

13. The heat exchanger according to claim 12, wherein said each of first and second distributor arms have a plurality of through openings, through which liquid (F) to be distributed is released to said tube bundle (10), whereby the cross-sectional surface area of at least one through opening of the first distributor arm is different from a cross-sectional surface area of a through opening of the second distributor arm and/or the through openings of the two distributor arms are distributed differently along the distributor arm.

14. The heat exchanger according to claim 1, wherein said central pipe (100) has a longitudinal axis and said distributor arms (300) are connected to said central pipe (100) by slotted through openings (310) wherein said slotted through openings (310) extend in the direction of said longitudinal axis of said central pipe.

15. The heat exchanger according to claim 1, wherein said shell (200) has a longitudinal axis and said drain pipes (340) extend downward from said ring channel (400) in the direction of said longitudinal axis of said shell (200) towards said distributor arms (300) for supplying said distributor arms (300) with liquid (F).

16. The heat exchanger according to claim 4, wherein said chimney (110) is arranged coaxially within said central pipe (100).

17. The heat exchanger according to claim 1, further comprising an inlet (510) provided on said shell (200) for supplying said ring channel (400) with liquid (F).

18. A heat exchanger comprising:

a tube bundle (10) comprising a plurality of tubes wound around a central pipe (100), a shell (20) enclosing said tube bundle (10) and defining a shell space (200) that surrounds said tube bundle (10), and a liquid distributor (30) comprising distributor arms (300) for distributing a liquid (F) into said shell space (200) and onto said tube bundle (10), and drain pipes (340) for supplying said distributor arms (300) with liquid (F), wherein said distributor arms (300) are connected in a flow-guiding manner to a ring channel (400) that is positioned along the periphery of the shell (20), wherein said ring channel (400), drain pipes (340), and distributor arms (300) are arranged so that liquid can flow from said ring channel (400) directly into said drain pipes (340), and from said drain pipes (340) directly into said distributor arms (300), and wherein said central pipe (100) provides for degassing liquid (F) to be distributed that is accumulated in said distributor arms (300), and said central pipe (100) is connected in a flow-guiding manner to said distributor arms (300).

19. A method of operating a heat exchanger according to claim 1, said method comprising:

introducing a liquid (F) into said heat exchanger via said inlet (510) whereby said liquid (F) is supplied to said ring channel (400), and said liquid (F) flows from said ring channel (400) through said drain pipes (340) directly into said distributor arms (300) of said liquid distributor (30);

degassing said liquid (F) accumulated in said distributor arms (300) via said central pipe (100); and distributing said liquid (F) from said distributor arms (300) onto said tube bundle (10).

* * * * *